US006657142B2

(12) United States Patent
Wang et al.

(10) Patent No.: US 6,657,142 B2
(45) Date of Patent: Dec. 2, 2003

(54) POWER SWITCH APPARATUS

(75) Inventors: Shih-Chieh Wang, Taipei (TW); Yen-Te Chiang, Taipei (TW); Chien-Lung Huang, Taipei (TW); James Tseng, Shulin (TW); Chu-Yang Hsu, Hsinchu (TW); Hsi-Hsing Hsu, Taoyuan (TW)

(73) Assignee: High Tech Computer, Corp., Taoyuan (TW)

( * ) Notice: Subject to any disclaimer, the term of this patent is extended or adjusted under 35 U.S.C. 154(b) by 0 days.

(21) Appl. No.: 10/235,843

(22) Filed: Sep. 6, 2002

(65) Prior Publication Data

US 2003/0057070 A1 Mar. 27, 2003

(30) Foreign Application Priority Data

Sep. 7, 2001 (TW) ..... 90215463 U

(51) Int. Cl.[7] ..... H01H 27/00
(52) U.S. Cl. ..... 200/43.04; 200/334; 200/61.63
(58) Field of Search ..... 200/43.04, 43.05, 200/43.07, 43.09, 43.11, 43.16, 43.19, 334, 332, 61.63; 345/173, 179, 180

(56) References Cited

U.S. PATENT DOCUMENTS 4,144,423 A * 3/1979 Fohl ..... 200/61.58 B
4,672,160 A * 6/1987 Katoh ..... 219/10.55 C
5,621,198 A * 4/1997 Betend-Bon ..... 200/61.58 R
5,898,143 A * 4/1999 Da Dalt ..... 200/17 R
6,100,479 A * 8/2000 Fust et al. ..... 200/329
6,160,324 A * 12/2000 Terada et al. ..... 307/116
6,177,926 B1 * 1/2001 Kunert ..... 345/173
6,249,276 B1 * 6/2001 Ohno ..... 345/173

* cited by examiner

*Primary Examiner*—Elvin Enad
*Assistant Examiner*—K. Lee
(74) *Attorney, Agent, or Firm*—Rabin & Berdo, P.C.

(57) ABSTRACT

A power switch apparatus is disclosed wherein the switch apparatus is applicable in an electronic product comprising a switch device capable of being switched between ON and OFF conditions. The power switch apparatus comprises an active element and a flexible arm. The active element installed inside the electronic product comprises a first connector and is coupled to the switch device. The ON and OFF conditions of the switch device correspond to the different positions of the active element. The flexible arm comprises a second connector and a contactor. The second connector is used to clip with the first connector at the ON condition. The electronic product is configured such that the contactor is not covered and remains accessible. The movement of the contactor is able to transform the shape of the flexible arm and to release the clipping relation between the first connector and the second connector.

20 Claims, 3 Drawing Sheets

POWER SWITCH APPARATUS

This application incorporates by reference Taiwan application Serial No. 90215463, filed Sep. 07, 2001.

BACKGROUND OF THE INVENTION

1. Field of the Invention

This invention relates to a power switch apparatus equipped in a personal digital assistant (PDA), particularly to a power switch apparatus capable of preventing the loss of data due to accidentally turning off the power.

2. Description of the Related Art

The personal digital assistant (PDA) has been popular in the market owing to the characteristics of convenience and portability. More and more people select PDAs to replace notebooks, calendar books, and address books. However, a session of using the PDA is often interrupted by turning off the power switch unintentionally because the power switch is installed on the surface of the PDA. This interruption can cause the lost of unsaved data and frustration for the user. The said power switch design allows the user to turn on the PDA by simply pushing the power switch. However such configurations increase the probability of erroneously turning off the power switch and ending the session before the user is prepared to do so.

From the above description, the conventional configuration of the power switch needs to be revised to prevent unintentionally turning off the power switch and causing the accidental loss of data.

SUMMARY OF THE INVENTION

Accordingly, an object of the present invention is to provide a power switch apparatus with one-step turning-on and two-step turning-off operations. Another object of the present invention is to provide a power switch apparatus capable of preventing the loss of data caused by unintentionally turning off the power switch apparatus.

The power switch apparatus of the present invention is applicable in an electronic product comprising a switch device capable of being switched between the ON and OFF conditions. The power switch apparatus comprises an active element and a flexible arm. The active element installed inside the electronic product comprises a first connector and is coupled to the switch device. The ON and OFF conditions of the switch device correspond to the different positions of the active element along a first direction. The flexible arm installed inside the electronic product comprises a fixer, a contactor, and a second connector. The fixer is positioned at one end of the flexible arm and is connected to the housing of the electronic product. The contactor is positioned at the other end of the flexible arm and is able to move along a second direction. The second connector is used to clip with the first connector at the ON condition.

When the power switch apparatus is at the OFF condition, the active element moves along the first direction and the first connector slides over the second connector. At the same time, the active element promotes the shifting of the switch device until the power switch apparatus is changed to the ON condition. The active element is not able to move due to the locking relation between the first connector and the second connector. If the power switch apparatus is changed to the OFF condition, the flexible arm will be deformed by the pushing of the contactor. Therefore, the locking relation between the first connector and the second connector is released and the active element promotes the shifting of the switch device.

BRIEF DESCRIPTION OF THE DRAWINGS

The above objects and other advantages of the present invention will become apparent from the following detailed description of the preferred embodiment of the present invention with reference to the attached drawings in which.

DESCRIPTION OF THE PREFERRED EMBODIMENTS

Figure 1A:
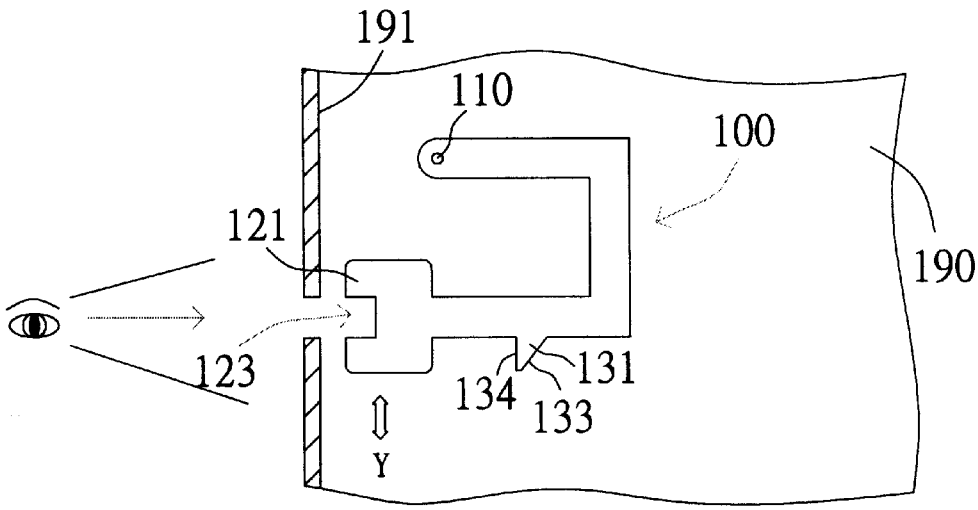
FIG. 1A shows the top view of a flexible arm according to the preferred embodiment of the present invention.

The present invention discloses a power switch apparatus comprising a flexible arm and an active element. Please refer to FIG. 1A, which shows the top view of a flexible arm according to the preferred embodiment of the present invention. The flexible arm 100 equipped in a housing 190 is composed of a flexible material, such as a plastic, spring, and so forth. The flexible arm 100 comprises a fixer 110, a contactor 121, and a connector 131. The fixer 110 is positioned at one end of the flexible arm 100 and is used to fix the flexible arm 100 to the housing 190. The contactor 121 is positioned at the other end of the flexible arm 100 and comes in contact with an inner side 191 of the housing 190. The surface of the contactor 121 in contact with the inner side 191 further comprises a recess 123. The connector 131 comprises a sliding surface 133 and a clipping surface 134.

Figure 1B:
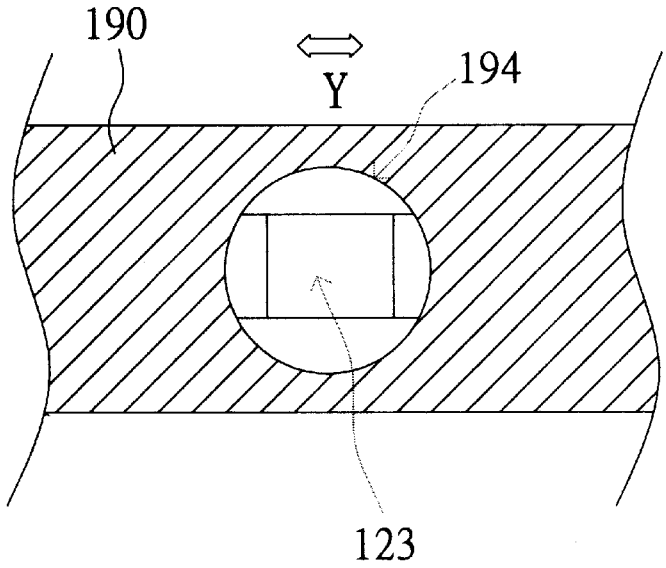
FIG. 1B shows the side view of the flexible arm arrangement of FIG. 1A.

Next, FIG. 1B shows the condition of FIG. 1A as viewed from the left side. As shown in FIG. 1B, there is a hole 194 on the housing 190, and a touch pen (not shown in the figure) attached with a PDA can pass through the hole 194 to push the contactor 121. The hole 194 is positioned directly opposite to the recess 123, such that the recess 123 is not covered by the housing 190 and remains exposed to the external environment.

Figure 1C:
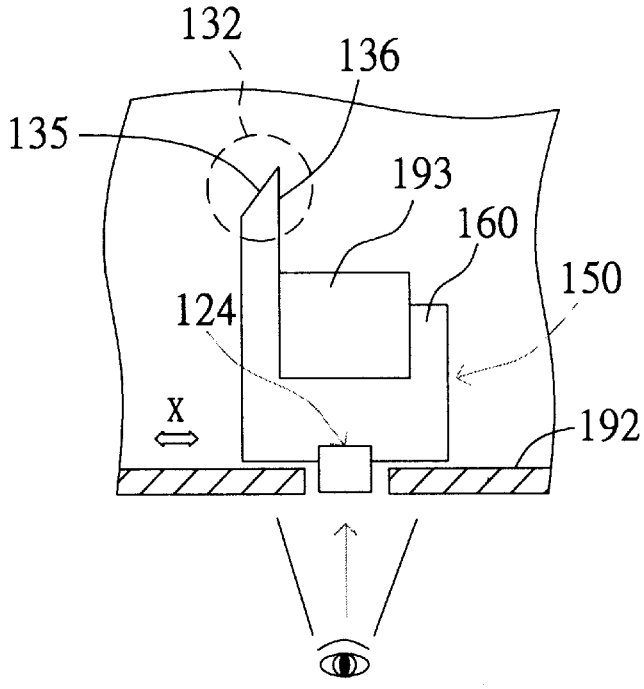
FIG. 1C shows the top view of an active element according to the preferred embodiment of the present invention.

Please refer to FIG. 1C, which shows the top view of an active element according to the preferred embodiment of the present invention. As shown in FIG. 1C, there is a switch device 193 inside the housing 190, and the switch device 193 is electrically connected to the battery (not shown in the figure) of the PDA. The positions of the switch element 193 indicate that the power is ON or OFF. The active element 150 installed in the housing 190 can move along the X direction and it comprises a sustaining arm 160 and a connector 132. The sustaining arm 160 can clip the switch device 193 to change the position of the switch device 193, as the active element 150 shifts along the X direction. The connector 132 comprises a sliding surface 135 and a clipping surface 136, which form the shape shown in FIG. 1C. The active element 150 is attached to an inner side 192 of the housing 190 and a surface of the active element 150 in contact with the inner side 192 further comprises a recess 124.

Figure 1D:
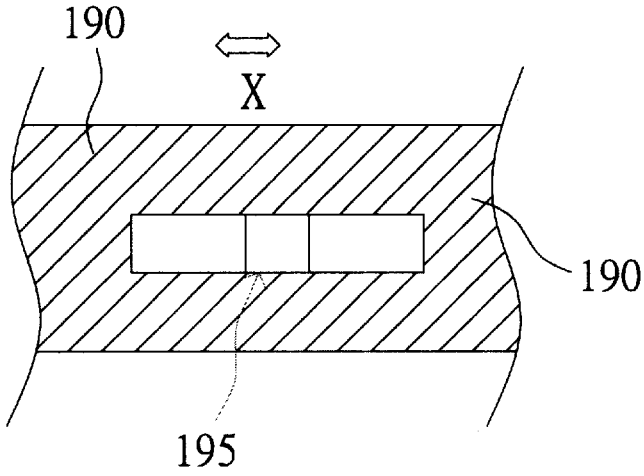
FIG. 1D shows the side view of the active element arrangement of FIG. 1C.

Referring to FIG. 1D, it shows the condition of FIG. 1C as viewed from the left side. In FIG. 1D, a fingering structure 195 is directly inside the recess 124 and it can promote the moving of the recess 124. From the outer surface of the housing 190, a user can finger the fingering structure 195 along the X direction and the recess 124 is shifted so as to move the whole active element 150. Therefore, the sustaining arm 160 clipping the switch device 193 moves accordingly.

Figure 2C:
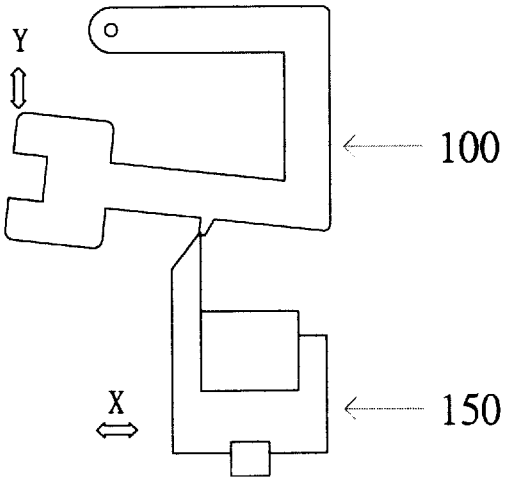
FIG. 2C shows the flexible arm elevated according to the power switch apparatus of FIG. 2B in the power-ON condition.
Figure 2B:
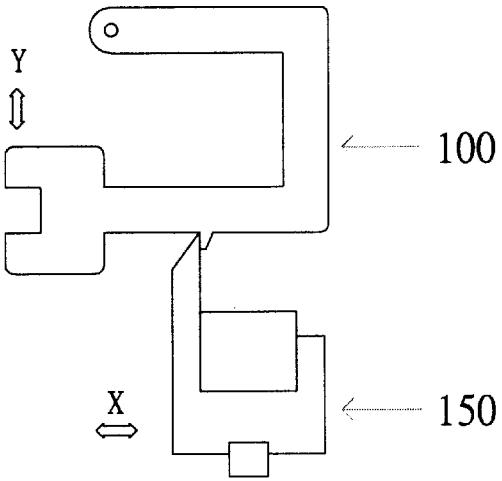
FIG. 2B shows a power switch apparatus of FIG. 2A in the power-ON condition.
Figure 2A:
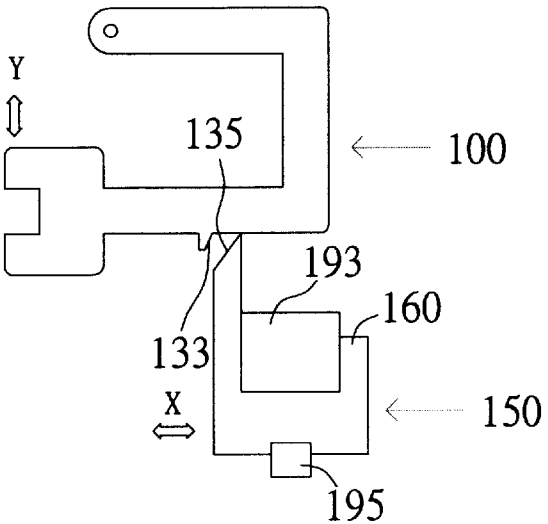
FIG. 2A shows a power switch apparatus in the power-OFF condition after the flexible arm of FIG. 1A combines with the active element of FIG. 1C.

Next, FIG. 2A shows a power switch apparatus in the power-OFF condition after the flexible arm of FIG. 1A combines with the active element of FIG. 1C. The flexible arm 100 and the active element 150 are both equipped on the housing 190 (not shown in FIG. 1C). As the fingering structure 195 promotes a moving of the active element 150 along the X direction, the sliding surface 135 slides over the sliding surface 133 and the flexible arm 100 is elevated slightly. The flexible arm 100 is composed of a flexible material, such that the connector 132 can slide over the connector 131. At the same time, the sustaining arm 160 moves by clipping the switch device 193 until the switch device 193 is at the ON condition.

Referring to FIG. 2B, it shows a power-ON condition of the power switch apparatus of FIG. 2A. The clipping surface 134 of FIG. 1A is attached to the clipping surface 136 of FIG. 1C. The connector 132 is locked by the connector 131 and thus the power source cannot be turned off by moving only the active element 150.

Referring to FIG. 2C, it shows that the flexible arm 100 is elevated according to the power-ON condition of FIG. 2B. The size of the hole 194 is designed such that a touch pen attached with the PDA can pass through. By utilizing the touch pen, the contactor 121 is pushed along the Y direction and the flexible arm 100 is deformed to be elevated slightly. Accordingly, the clipping surface 134 separates from the clipping surface 136, as shown in FIG. 2C. Upon separation, the active element 150 is pushed along the X direction and the sustaining arm 160 promotes the moving of the switch device 193 to turn off the power source.

From the above description, a power switch apparatus comprising a flexible arm 100 and an active element 150 is disclosed in the present invention. The turning-off operation comprises two steps: first, moving the flexible arm 100 and then, pushing the active element 150. Moreover, a touch pen is required to be used in the step of moving the flexible arm 100. Compared with the conventional power switch configuration, the complexity of the turning-off operation disclosed herein is increased and thus, the probability of turning off the power source erroneously is decreased. Furthermore, the turning-on operation is still only one step, and the operating convenience is not affected.

Once given the above disclosure, many other features, modifications, and improvements will become apparent to the skilled artisan. Such other features, modifications, and improvements are, therefore, considered to be a part of this invention, and the scope of the following claims should be accorded the broadest interpretation.

What is claimed is:

1. A power switch apparatus applicable in an electronic product, said electronic product comprising a switch device capable of being switched between ON and OFF conditions, said power switch apparatus comprising:

an active element comprising a first connector, said active element installed inside said electronic product and coupled to said switch device, said ON and OFF conditions of said switch device corresponding to the different positions of said active element; and a flexible arm installed inside said electronic product, said flexible arm comprising:

a second connector for clipping with said first connector in said ON condition, and a contactor not covered by said electronic product, the moving of said contactor able to transform the shape of said flexible arm and to release the clipping relation between said first connector and said second connector.

2. The power switch apparatus of claim 1, wherein said electronic product is a personal digital assistant (PDA).

3. The power switch apparatus of claim 1, wherein said flexible arm is composed of a flexible material.

4. The power switch apparatus of claim 3, wherein said flexible material is plastic.

5. The power switch apparatus of claim 3, wherein said flexible material is spring.

6. The power switch apparatus of claim 1, wherein said electronic product further comprises a hole on a housing thereof for exposing said contactor.

7. The power switch apparatus of claim 6, wherein the size of said hole is designed such that a touch pen can pass through.

8. The power switch apparatus of claim 1, wherein the moving of said active element can be controlled from the outside of said electronic product.

9. A power switch apparatus applicable in an electronic product, said electronic product comprising a switch device capable of being switched ON and OFF conditions, said power switch apparatus comprising:

an active element comprising a first connector, said active element installed inside said electronic product and coupled to said switch device, said ON and OFF conditions of said switch device corresponding to the different positions of said active element along a first direction; and a flexible arm installed inside said electronic product, said flexible arm comprising:

a fixer positioned at one end of said flexible arm, said fixer connected to a housing of said electronic product, a contactor positioned at the other end of said flexible arm, said contactor able to move along a second direction, and a second connector for clipping with said first connector in said ON condition, wherein said power switch apparatus in said OFF condition, said active element moving along said first direction, said first connector sliding over said second connector, said active element promoting the shifting of said switch device until said power switch apparatus switched to said ON condition; at this time, said active element not able to move due to the locking relation between said first connector and said second connector, as said power switch apparatus required to switch to said OFF condition, said flexible arm deformed by pushing said contactor, said locking relation between said first connector and said second connector released, said active element promoting the shifting of said switch device until said power switch apparatus in said OFF condition.

10. The power switch apparatus of claim 9, wherein said electronic product is a personal digital assistant (PDA).

11. The power switch apparatus of claim 9, wherein said flexible arm is composed of a flexible material.

12. The power switch apparatus of claim 11, wherein said flexible material is plastic.

13. The power switch apparatus of claim 11, wherein said flexible material is spring.

14. The power switch apparatus of claim 9, wherein said first connector comprises a first sliding surface and a first clipping surface.

15. The power switch apparatus of claim 14, wherein said second connector comprises a second sliding surface and a second clipping surface.

16. The power switch apparatus of claim 15, wherein said second sliding surface is attached to said first sliding surface, while said power switch apparatus is in ON condition.

17. The power switch apparatus of claim 9, wherein said contactor further comprises a recess.

18. The power switch apparatus of claim 17, wherein said electronic product further comprises a hole opposite to said recess, said hole positioned on a housing of said electronic product.

19. The power switch apparatus of claim 18, wherein the size of said hole is designed such that a touch pen can pass through.

20. The power switch apparatus of claim 9, wherein the moving of said active element can be controlled from the outside of said electronic product.

* * * * *